US011572245B2

(12) United States Patent
Cuevas Padilla

(10) Patent No.: US 11,572,245 B2
(45) Date of Patent: Feb. 7, 2023

(54) AUTOMATED DEVICE AND PROCEDURE TO TRANSFER AND THREAD A BEARING BAND

(71) Applicant: Desmasa, S.L. (DESARROLLO DE MÁQUINAS Y SOLUCIONES AUTOMÁTICAS, S.L.), Burgos (ES)

(72) Inventor: Carlos Cuevas Padilla, Burgos (ES)

(73) Assignee: DESMASA, S.L. (DESARROLLO DE MAQUINAS Y SOLUCIONES AUTOMATICAS, S.L.), Burgos (ES)

( * ) Notice: Subject to any disclaimer, the term of this patent is extended or adjusted under 35 U.S.C. 154(b) by 76 days.

(21) Appl. No.: 17/114,686

(22) Filed: Dec. 8, 2020

(65) Prior Publication Data

US 2021/0179377 A1 Jun. 17, 2021

(30) Foreign Application Priority Data

Dec. 12, 2019 (EP) ..... 19383103

(51) Int. Cl.
*B65H 18/16* (2006.01)
*B65H 18/14* (2006.01)

(52) U.S. Cl.
CPC ..... *B65H 18/145* (2013.01); *B65H 18/16* (2013.01)

(58) Field of Classification Search
CPC ..... B65H 18/16; B65H 18/145; B65H 19/28; B65H 19/30; B65H 23/16
See application file for complete search history.

(56) References Cited

U.S. PATENT DOCUMENTS

| | | | | |
|---|---|---|---|---|
| 9,845,221 | B2 * | 12/2017 | Hack | B65H 54/553 |
| 2005/0029389 | A1 | 2/2005 | Reinke et al. | |
| 2013/0126660 | A1 | 5/2013 | Guyomard et al. | |
| 2013/0248641 | A1 | 9/2013 | Niwa et al. | |
| 2019/0315588 | A1 * | 10/2019 | Amari | B65H 23/16 |

FOREIGN PATENT DOCUMENTS

| | | | |
|---|---|---|---|
| EP | 3556697 | A1 | 10/2019 |
| WO | 2019007585 | A1 | 1/2019 |

* cited by examiner

*Primary Examiner* — Sang K Kim
(74) *Attorney, Agent, or Firm* — Hayes Soloway PC

(57) ABSTRACT

The invention relates to an automated device to transfer and thread a bearing band (3) on a fixed reel (2) from a removable reel (1), said reels (1,2) being joined and integral to corresponding shafts (4,5), wherein said device comprises a folding arm (6) adapted to perform a translational movement, which in turn comprises a hook (7) and a carriage (8) configured to move the arm (6) horizontally between both reels (1,2), and wherein the device further comprises a tensioning roller (10) adapted to move vertically through an intermediate column (11), such that it allows the first bearing band (3) to be transferred between reels (1,2) automatically in order to finally wind a second bearing band (12) with the first bearing band (3) onto the removable reel (1) automatically and simultaneously.

8 Claims, 5 Drawing Sheets

AUTOMATED DEVICE AND PROCEDURE TO TRANSFER AND THREAD A BEARING BAND

CROSS-REFERENCE TO RELATED APPLICATIONS AND PRIORITY

This patent application claims priority from European Patent Application No. 19383103.9 filed Dec. 12, 2019. This patent application is herein incorporated by reference in its entirety.

OBJECT OF THE INVENTION

The present invention relates to an automated device and procedure that make it possible to transfer and thread a first bearing band on a fixed reel from a removable reel automatically. More particularly, the present invention describes a folding arm adapted to perform a translational movement, which in turn comprises a hook and a carriage adapted to move said arm such that, by means of an automated process that uses said device, it is possible to transfer and thread the first bearing band on the fixed reel automatically, with the purpose of finally winding and/or unwinding a second bearing band with a first bearing band in the removable reel automatically and simultaneously.

BACKGROUND OF THE INVENTION

In numerous manufacturing processes, e.g. tyres, it is necessary to wind a bearing band onto a reel or coil, for later use in subsequent processes.

In such processes, it is necessary to simultaneously wind a plastic band to prevent the bearing band from sticking when wound onto the reel.

This process is currently done manually by an operator, which significantly slows down the process execution time and the overall productivity.

DESCRIPTION OF THE INVENTION

The present invention aims to solve some of the problems mentioned in the state of the art. More specifically, in a first aspect, the present invention describes an automated device to transfer and thread a bearing band on a fixed reel from a removable reel, wherein said reels are joined and integral to corresponding support shafts adapted to rotate by means of corresponding motors, wherein said device is characterised in that it further comprises:

a folding arm adapted to perform a translational movement between a pick-up angle position and a threading position, which in turn comprises a hook in an upper portion configured to pick up the bearing band of the removable reel in the pick-up angle position, and to place the bearing band on the fixed reel in the threading angle position, and wherein said arm further comprises a carriage, which is rigidly attached to a lower portion thereof, and a bed adapted to allow the horizontal rectilinear relative motion of the carriage between the removable reel and the fixed reel by means of horizontal transport elements.

A second aspect of the invention describes an automated process that uses the device described above to transfer and thread a bearing band (3) on a fixed reel from a removable reel, comprising the following steps:

A.—rotating the removable reel to wind the first bearing band onto said reel,

B.—lowering the control roller from the upper limit level to the lower limit level of said intermediate column, C.—moving the folding arm horizontally until the removable reel is reached, D.—rotating the folding arm to the pick-up position such that the hook picks up a tip of the first bearing band wound onto the removable reel, E.—moving the arm horizontally to the fixed reel, F.—rotating the folding arm to the threading position such that the hook rests on the fixed reel to thread the tip of the first bearing band on said fixed reel, G.—raising the roller up to a vertical position by simultaneously housing and tensioning the first bearing band, G.—rotating both reels in a first direction of rotation by transferring the first bearing band wound onto the removable reel until it is partially wound onto the fixed reel, leaving a portion of the first bearing band still wound onto the first reel, H.—placing a tip of the second bearing band on the removable reel and rotating both reels in a second direction of rotation which is opposite the first direction of rotation, thus allowing the first bearing band to be simultaneously wound with the bearing band.

DESCRIPTION OF THE DRAWINGS

To supplement the description that is being made and in order to aid a better understanding of the features of the invention according to a preferred example of a practical embodiment thereof, a set of drawings has been attached as an integral part of said description, which represent the following by way of illustration and not limitation.

PREFERRED EMBODIMENT OF THE INVENTION

Figure 1:
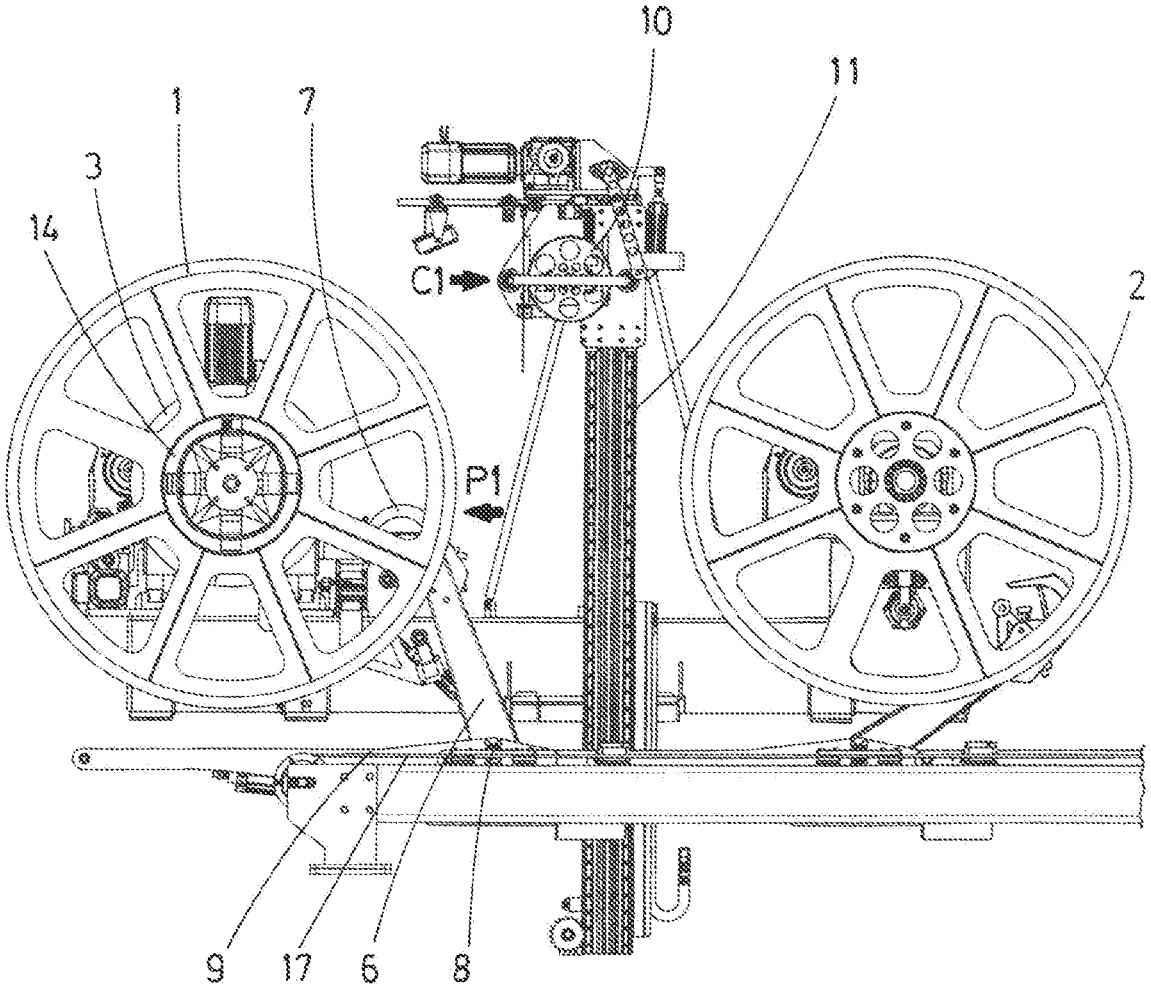
FIG. 1 shows a front view of the device in a preferred embodiment of the invention, showing the removable reel, the fixed reel, the first bearing band, the arm and its corresponding hook in a pick-up position.

A preferred embodiment of the object of the invention is detailed below with the aid of the above-mentioned FIGS. 1-5.

The invention relates to an automated device to transfer and thread a bearing band (3) on a fixed reel (2) from a removable reel (1), with the aim of also finally transferring and winding and/or unwinding said first bearing band (3)

with a second bearing band (12) alternatively between the removable reel (1) and the fixed reel (2).

More particularly, the object of the invention is to transfer and thread a bearing band (3) on a fixed reel (2) from a removable reel (1), in order to avoid interaction and manual execution from an operator, thereby increasing the overall efficiency and productivity of the process, to ensure that the operator does not have to manually thread said bearing band (12) each time the manoeuvre is to be executed. In addition, it makes it possible to finally remove the removable reel (1) with the first bearing band (3) wound and ready and located in between the second bearing band (12) in an automated manner. This is especially useful in many industrial processes, for example in tyre manufacturing.

In a first aspect of the invention, the device will be described according to a preferred embodiment.

The removable reel (1) and the fixed reel (2) are joined to corresponding support shafts (4,5) adapted to rotate by means of corresponding motors (18).

Figure 3:
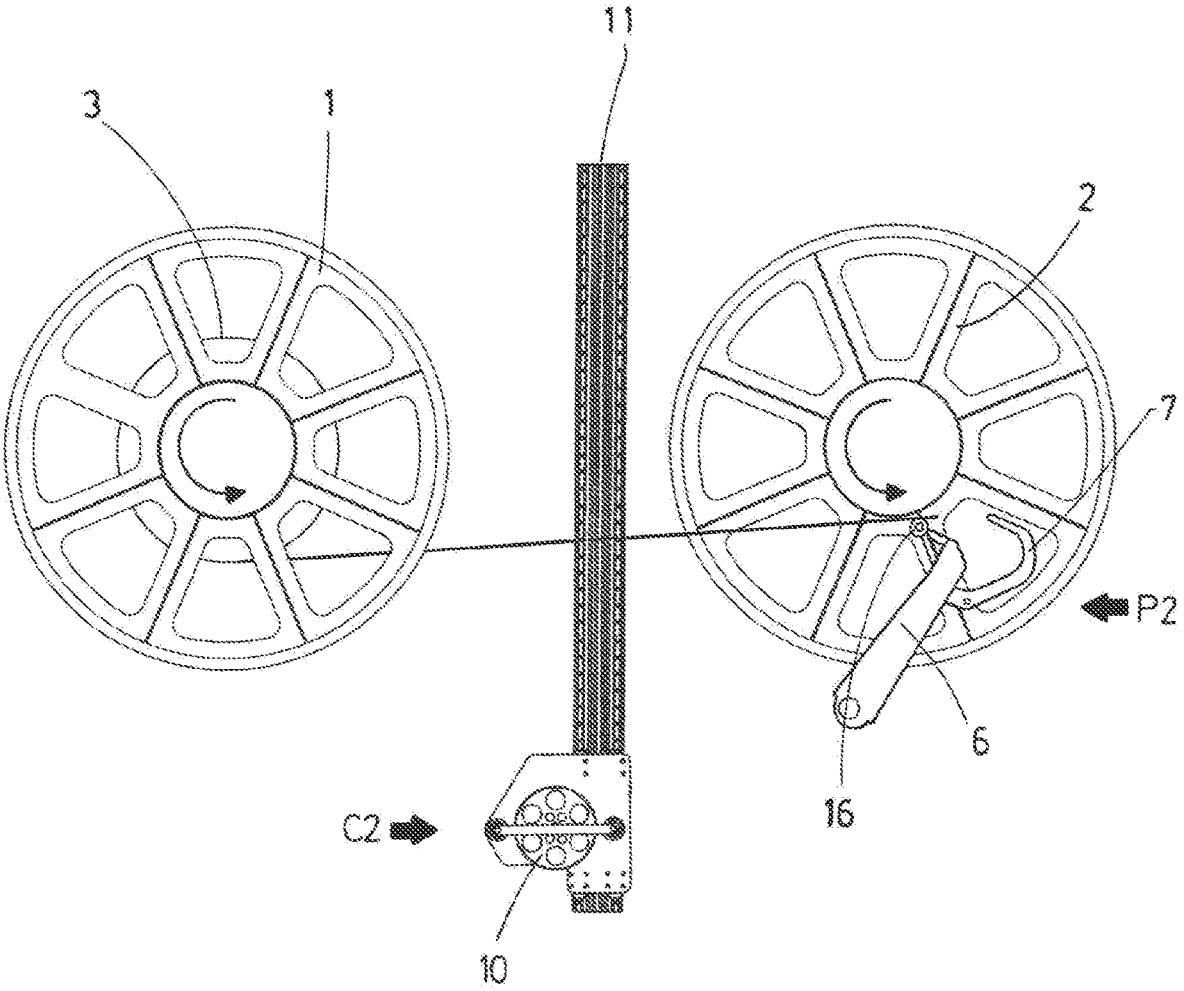
FIG. 3 shows a schematic view of the device in a preferred embodiment, wherein the tensioning roller is shown in a position in the lower limit level and the arm is shown in a threading position for threading the tip of the first bearing band on the fixed reel.

As shown in FIG. 1, the device comprises a folding arm (6) adapted to perform a translational movement between a pick-up position (P1) and a threading position (P2), which can be seen in FIG. 3.

FIG. 1 also shows that said arm (6) in turn comprises a hook (7) on an upper portion configured to pick up the first bearing band (3) of the removable reel (1) in the pick-up angle position (P1), and to place the first bearing band (3) on the fixed reel (2) in the threading angle position (P2).

FIG. 1 also shows that the arm (6) further comprises a carriage (8), which is rigidly attached to a lower portion thereof and is configured to move over a bed (9), such that it can move alternatively from the removable reel (1) to the fixed reel (2) by means of horizontal transport elements (17).

The device further includes an intermediate column (11) located between said reels (1,2), comprising at least one tensioning roller (10) adapted to house the first bearing band (3) on an outer perimeter of said roller (10) and configured to be moved vertically between an upper limit level (C1) and a lower limit level (C2) shown in FIG. 3. This vertical movement is performed by vertical transport elements (not shown).

Figure 2:
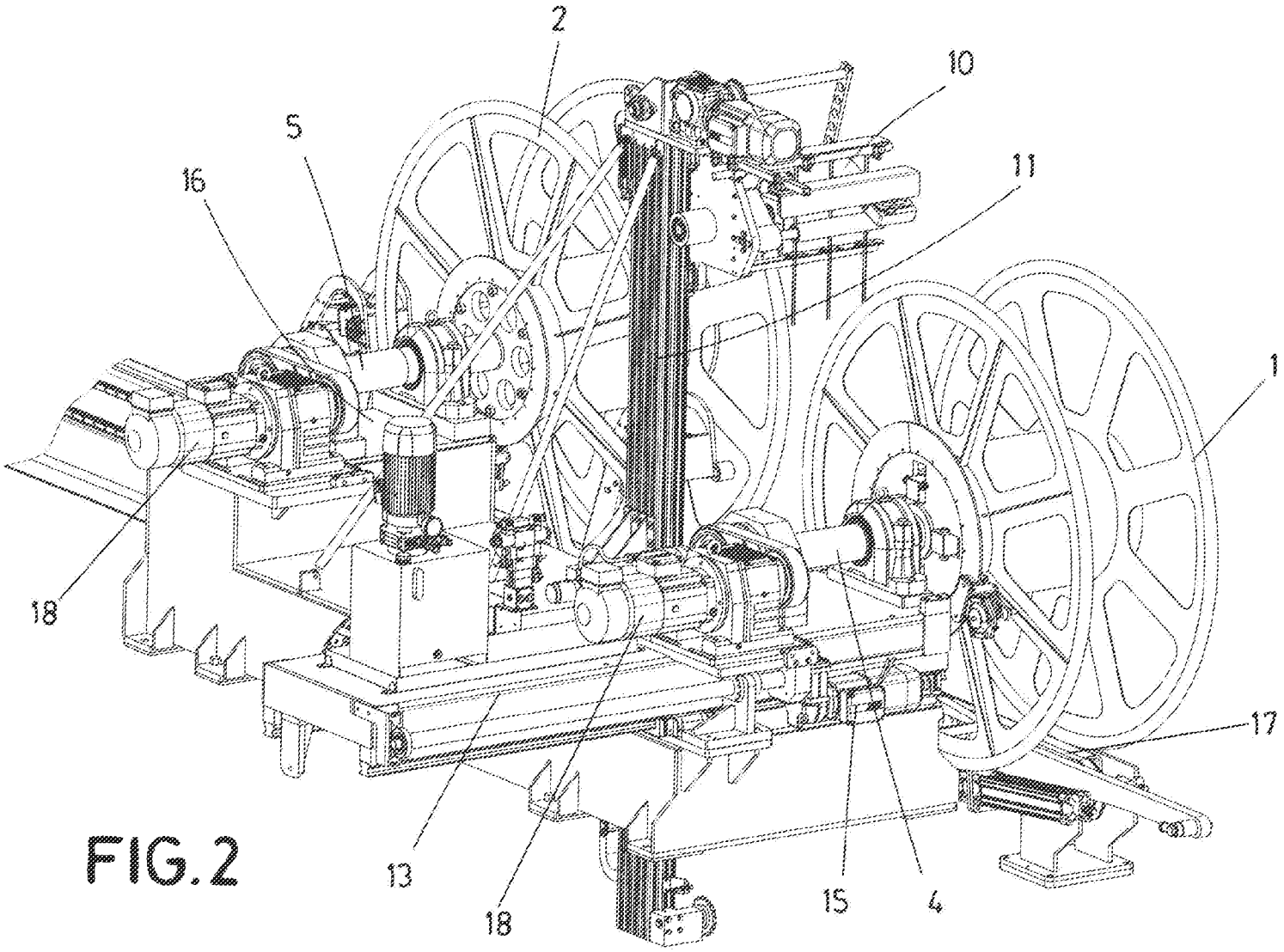
FIG. 2 shows a perspective view of the preferred embodiment described in FIG. 1, which clearly shows the first shaft, the second shaft, the moving base, the fixed base and the rectilinear transport means of said moving base in the longitudinal direction of the first shaft.

FIG. 2 shows a perspective view of the preferred embodiment described above, showing that the removable reel (1) comprises rectilinear transport elements (15) for moving the removable reel (1) in the longitudinal direction of the first shaft (4).

A gripping system (14) is joined to a distal portion of said first shaft (4) to grip and release the removable reel (1). The gripping means (14) in a preferred embodiment are jaws.

FIG. 2 also shows that the device comprises a moving base (13) connected to the rectilinear transport means (15), wherein the first shaft (4) and the gripping elements (14) are assembled, such that it allows the removable reel (1), the gripping means (14) and the first shaft (4) to move in the direction of the first shaft (4).

The device further comprises a fixed supporting base (16) for the second shaft (5) and the second fixed reel (2) with fastening elements to limit the fixed reel (2) and the second shaft (5) exclusively to rotary motion.

With the help of FIGS. 1-5, below, a second aspect of the invention is detailed, wherein a process for the use of the device described above is described.

The process includes a step of rotating the removable reel (1) until the first bearing band (3) is wound onto that reel (1).

It then comprises lowering the control roller (10) from the upper limit level (C1) to the lower limit level (C2) of said intermediate column (11) using the vertical transport elements.

Then, moving the folding arm (6) horizontally until the removable reel (1) is reached, and rotating the folding arm (6) to the pick-up position (P1) such that the hook (7) picks up a tip of the first bearing band (3) wound onto the removable reel (1), as illustrated in FIG. 1.

The arm (6) then moves horizontally until it reaches the fixed reel (2) and said folding arm (6) is rotated to the threading position (P2), such that the hook (7) rests on the fixed reel (2) to thread the tip of the first bearing band (3) on said fixed reel (2), as shown in FIG. 3.

Figure 4:
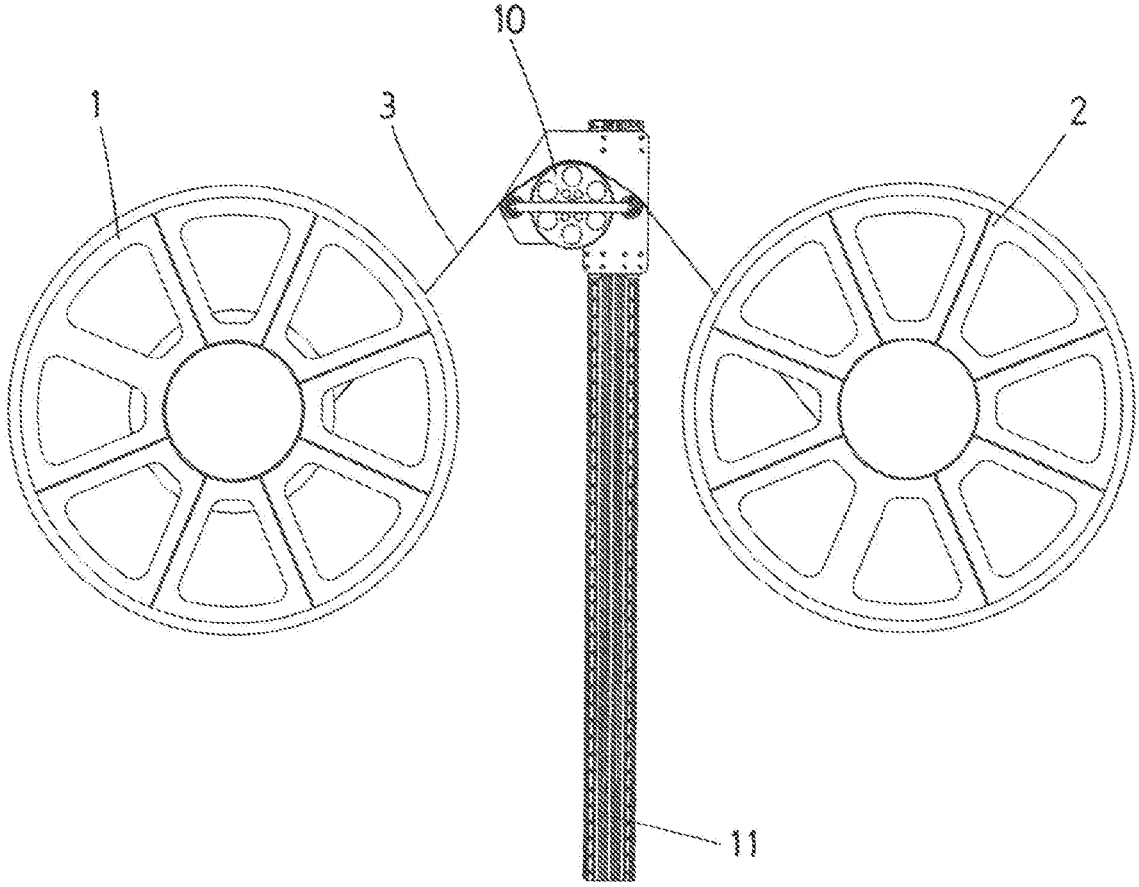
FIG. 4 shows a schematic view of the device in a preferred embodiment, wherein the tensioning roller is shown in a position in the upper limit level housing and tensioning the first bearing band.
Figure 5:
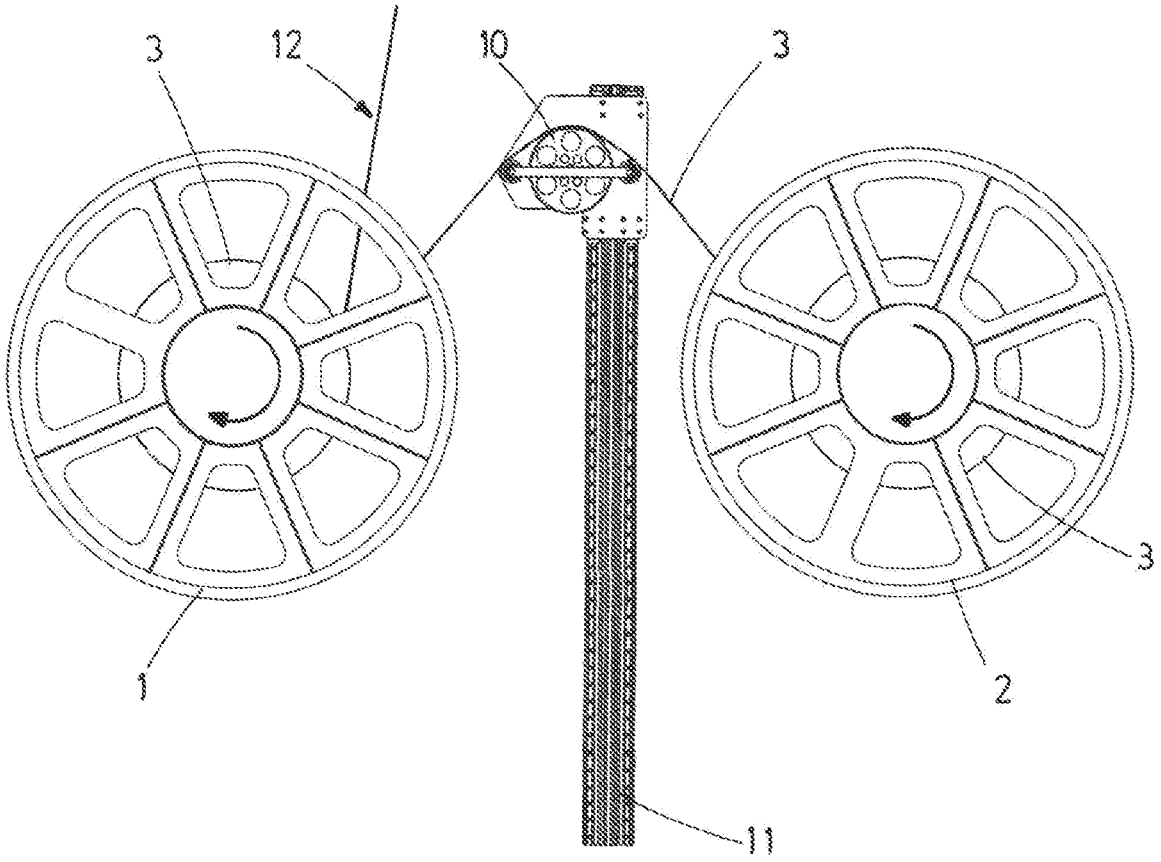
FIG. 5 shows a schematic view of the device in a preferred embodiment, which shows the first bearing band partially wound onto the fixed roller, the bearing band placed on the removable roller, and the rollers rotating in an opposite direction of rotation for winding the first bearing band with the second bearing band simultaneously.

The process then comprises raising the tensioning roller (10) to a vertical position by simultaneously housing and tensioning the first bearing band (3), as illustrated in FIG. 4.

This way, the band (3) wound onto the removable reel (1) can then be transferred and be partially wound onto the fixed reel (2) by rotating both reels in a first direction, leaving a few unwound wraps of the first bearing band (3) on the first reel (1).

Finally, the process comprises placing a tip of the second bearing band (12) on the removable reel (1) and rotating both reels (1,2) in a second direction of rotation which is opposite the first direction of rotation, thus allowing the first bearing band (3) to be simultaneously wound with the bearing band (12) in the removable reel (1).

The invention claimed is:

1. Automated device to transfer and thread a bearing band on a fixed reel from a removable reel, wherein said reels are joined and integral to corresponding support shafts adapted to rotate by motors, wherein the device comprises: a folding arm adapted to perform a translational movement between a pick-up angle position and a threading position, which in turn comprises a hook in an upper portion configured to pick up the bearing band of the removable reel in the pick-up angle position, and to place the bearing band on the fixed reel in the threading angle position, and wherein said arm further comprises a carriage which is rigidly attached to a lower portion thereof, and a bed adapted to allow the horizontal rectilinear relative motion of the carriage between the removable reel and the fixed reel by a horizontal conveyor.

2. The automated device of claim 1, wherein the arm further comprises a tension roller located in an upper portion to facilitate the transfer of the bearing band in the threading position.

3. The automated device of claim 1, further comprising an intermediate column located between said reels, comprising at least one tensioning roller adapted to house the first bearing band on an outer perimeter of said roller and configured to be moved vertically and alternatively between an upper limit level and a lower limit level of said intermediate column.

4. The automated device of claim 1, wherein the removable reel is movable in the direction of the first shaft.

5. The automated device of claim 1, further comprising a fixed supporting base for the second shaft to limit the fixed reel and the second shaft to exclusively perform a rotary motion.

6. Automated process to transfer and thread a bearing band on a fixed reel from a removable reel, wherein said reels are joined and integral to corresponding support shafts adapted to rotate by means of corresponding motors, wherein the process is intended to be carried out in a device comprising:

a folding arm adapted to perform a translational movement between a pick-up angle position and a threading position, which in turn comprises a hook in an upper portion configured to pick up the bearing band of the removable reel in the pick-up angle position, and to place the bearing band on the fixed reel in the threading angle position, and wherein said arm further comprises a carriage which is rigidly attached to a lower portion thereof, and a bed adapted to allow the horizontal rectilinear relative motion of the carriage between the removable reel and the fixed reel by a horizontal conveyor; and wherein the process comprises the following steps:

a) rotating the removable reel to wind the first bearing band onto said removable reel, b) moving the folding arm horizontally until the removable reel is reached, c) rotating the folding arm to the pick-up position such that the hook picks up a tip of the first bearing band wound onto the removable reel, d) moving the folding arm horizontally to the fixed reel, e) rotating the folding arm to the threading position such that the hook rests on the fixed reel to thread a tip of the first bearing band on said fixed reel.

7. The automated process of claim 6, further comprising an additional step of:

f) rotating both reels in a first direction of rotation by transferring the first bearing band wound onto the removable reel with the aid of a tension roller, until said first band is partially wound onto the fixed reel, leaving a portion of the first bearing band wound onto the first reel.

8. The automated process of claim 7, which further comprises the steps of:

g) lowering a control roller from an upper limit level to a lower limit level of the intermediate column, after step a) and before step b), h) raising the roller up to a vertical position by simultaneously housing and tensioning the first bearing band, after step e) and before step f), and i) after step f), placing a tip of a second bearing band on the removable reel and rotating both reels in a second direction of rotation which is opposite the first direction of rotation, thus allowing the first bearing band to be simultaneously wound with the bearing band in the removable reel.

* * * * *